US009622558B2

(12) United States Patent
Magnus

(10) Patent No.: US 9,622,558 B2
(45) **Date of Patent: *Apr. 18, 2017**

(54) LEISURE, RECREATIONAL AND HOME-USE STREAMING APPARATUS

(71) Applicant: Yetimo International Pty Ltd, Surry Hills (AU)

(72) Inventor: Antony J. Magnus, Cremorne (AU)

(73) Assignee: YETIMO INTERNATIONAL PTY LTD, Surry Hills (AU)

( * ) Notice: Subject to any disclaimer, the term of this patent is extended or adjusted under 35 U.S.C. 154(b) by 0 days.

This patent is subject to a terminal disclaimer.

(21) Appl. No.: 14/809,845

(22) Filed: Jul. 27, 2015

(65) Prior Publication Data

US 2015/0327644 A1 Nov. 19, 2015

Related U.S. Application Data

(63) Continuation of application No. 13/485,667, filed on May 31, 2012, now Pat. No. 9,091,477.

(30) Foreign Application Priority Data

| | | |
|---|---|---|
| Jun. 1, 2011 | (AU) | 2011902159 |
| Jul. 22, 2011 | (AU) | 2011100904 |
| Feb. 29, 2012 | (AU) | 2012100217 |

(51) Int. Cl.
*A45C 15/00* (2006.01)
*A45C 11/00* (2006.01)
(Continued)

(52) U.S. Cl.
CPC ..... *A45C 11/00* (2013.01); *A45F 5/00* (2013.01); *A47C 7/72* (2013.01); *F25D 11/00* (2013.01);
(Continued)

(58) Field of Classification Search
CPC . A45C 5/04; A45C 11/20; A45C 15/00; A45F 3/04; A47C 7/72; B65D 85/00; F25D 23/12
(Continued)

(56) References Cited

U.S. PATENT DOCUMENTS 4,489,770 A 12/1984 Reich, II
4,489,779 A * 12/1984 Dickinson ..... E21B 43/129 166/105
(Continued)

FOREIGN PATENT DOCUMENTS

CA 2647922 A1 6/2009
CN 2789812 Y 6/2006
(Continued)

OTHER PUBLICATIONS

The "CoolerBerry II—Boombox Cooler with Streaming Bluetooth", Online video clip, www.youtube.com/watch?v=9mbkaHsLao, uploaded/published Jun. 18, 2011.
(Continued)

*Primary Examiner* — Bryon Gehman
(74) *Attorney, Agent, or Firm* — Kirton McConkie; David B. Tingey; Bryant J. Keller

(57) ABSTRACT

A leisure apparatus comprises a body having a volume that is able to contain articles for storage therein and for removal therefrom, or that defines an internal space that is able to seal therein a gas, liquid or solid. An output device is arranged externally at the body. A receiver is located behind a wall of the body to be separated from articles stored in and removed from the body, or is located and sealed within the internal space of the body. The receiver is adapted for receiving an electronic signal transmitted wirelessly from a proximate device and for communicating that signal to the output device.

20 Claims, 9 Drawing Sheets

(51) Int. Cl.

| | |
|---|---|
| ***A45F 5/00*** | (2006.01) |
| ***F25D 23/12*** | (2006.01) |
| ***A47C 7/72*** | (2006.01) |
| ***F25D 11/00*** | (2006.01) |
| *A45C 5/04* | (2006.01) |
| *A45C 11/20* | (2006.01) |
| *A45F 3/04* | (2006.01) |

(52) U.S. Cl.
CPC ..... *F25D 23/12* (2013.01); *A45C 5/04* (2013.01); *A45C 11/20* (2013.01); *A45F 3/04* (2013.01); *A45F 2005/002* (2013.01); *F25B 2600/07* (2013.01)

(58) Field of Classification Search
USPC ..... 62/457.1–457.9; 206/320, 541–549; 455/66.1
See application file for complete search history.

(56) References Cited

U.S. PATENT DOCUMENTS

| | | | | |
|---|---|---|---|---|
| 4,700,395 | A * | 10/1987 | Long | A45C 11/20 62/457.7 |
| 4,939,912 | A * | 7/1990 | Leonovich, Jr. | A45C 15/00 62/457.1 |
| 5,235,822 | A * | 8/1993 | Leonovich, Jr. | A45C 15/00 206/542 |
| 5,447,041 | A * | 9/1995 | Piechota | A45C 11/20 206/542 |
| 5,526,284 | A * | 6/1996 | Mankovitz | G11B 27/105 455/66.1 |
| 5,706,940 | A * | 1/1998 | Amarello | A45C 11/22 206/320 |
| 5,781,853 | A * | 7/1998 | Johnson | H04B 1/08 62/457.7 |
| 5,979,175 | A * | 11/1999 | Ellison | A45C 15/00 62/457.7 |
| 6,216,488 | B1 * | 4/2001 | Rucker | A45B 11/00 62/457.7 |
| 6,381,452 | B1 | 4/2002 | Tien et al. | |
| 6,980,788 | B2 * | 12/2005 | Peeples | F25D 23/12 381/118 |
| 7,188,491 | B2 * | 3/2007 | Donald, II | B62B 3/00 62/457.7 |
| 7,794,014 | B2 * | 9/2010 | Beall | A47C 7/72 297/217.3 |
| 7,806,271 | B1 * | 10/2010 | Kraska | A45C 11/20 206/541 |
| 8,631,942 | B2 | 1/2014 | Levy et al. | |
| 8,678,936 | B2 | 3/2014 | Lesley et al. | |
| 9,091,477 | B2 | 7/2015 | Magnus | |
| 2003/0157893 | A1 * | 8/2003 | Peeples | F25D 23/12 455/66.1 |
| 2004/0224638 | A1 | 11/2004 | Fadell et al. | |
| 2006/0223394 | A1 | 10/2006 | Porat | |
| 2007/0011341 | A1 | 1/2007 | Liang | |
| 2007/0170826 | A1 | 7/2007 | Tsao | |
| 2008/0031483 | A1 * | 2/2008 | Hill | F25D 23/12 381/334 |
| 2008/0037813 | A1 | 2/2008 | Entner | |
| 2008/0080734 | A1 | 4/2008 | Forth et al. | |
| 2008/0285223 | A1 | 11/2008 | Sugawara | |
| 2009/0021654 | A1 * | 1/2009 | Jones | A45C 15/00 348/838 |
| 2009/0071516 | A1 * | 3/2009 | Li | F21V 21/34 135/16 |
| 2009/0090127 | A1 | 4/2009 | Do | |
| 2009/0114554 | A1 | 5/2009 | Earnest | |
| 2009/0268923 | A1 * | 10/2009 | Li | A47B 37/04 381/77 |
| 2010/0126196 | A1 * | 5/2010 | McCance | A45C 11/20 62/457.7 |
| 2010/0320819 | A1 * | 12/2010 | Cohen | A61H 23/0236 297/217.4 |
| 2011/0105041 | A1 * | 5/2011 | Maruyama | G08C 17/02 455/66.1 |
| 2011/0297565 | A1 * | 12/2011 | Stratmann | A61C 17/221 206/320 |

FOREIGN PATENT DOCUMENTS

| | | | |
|---|---|---|---|
| CN | 201708877 | U | 1/2011 |
| GB | 2308775 | | 7/1997 |
| JP | 101072357 | | 11/2007 |
| KR | 10-2008-0034064 | | 4/2008 |
| KR | 20-2008-0001703 | U | 6/2008 |
| WO | WO 02/096152 | A1 | 11/2002 |

OTHER PUBLICATIONS

"Ice Chest Stereo", Online video clip, www.youtube.com/watch?v=1hBdqtMC3qE, uploaded/published Apr. 30, 2010.
"X Rocker Sound Chairs: Don't Just Sit There . . . Start Rocking!", X Rocker by Ace Bayou Corporation, 2011, pp. 1-2, www.thexrocker.com.
"Geek Gifts 2011: X Rocker Pro Series Pedestal Gaming Chair", TechRepublic, pp. 1-6, www.techrepublic.com/blog/geekend/geek-gifts-2011-x-rocker-pro-series-pedestal-gaming-chair/7041.
"I Love Motorboating", www.motorboatyourself.com Forums—Index, pp. 1-2.

* cited by examiner

LEISURE, RECREATIONAL AND HOME-USE STREAMING APPARATUS

RELATED APPLICATIONS

This is a continuation application that claims priority to U.S. patent application Ser. No. 13/485,667, filed May 31, 2012, and entitled "LEISURE, RECREATIONAL AND HOME-USE STREAMING APPARATUS", which claims priority to Australian Patent Application Serial No. 2012100217, filed Feb. 29, 2012, and entitled "LEISURE, RECREATIONAL AND HOME-USE APPARATUS", which claims priority to Australian Patent Application Serial No. 2011100904, filed Jul. 22, 2011, and entitled "LEISURE, RECREATIONAL AND HOME-USE APPARATUS", which claims priority to Australian Patent Application Serial No. 2011902159, filed Jun. 1, 2011, and entitled "LEISURE, RECREATIONAL AND HOME-USE APPARATUS", each of which is incorporated herein in its entirety by reference.

BACKGROUND OF THE INVENTION

1. Field of the Invention

Leisure, recreational and home-use apparatus are disclosed that have wireless capability. Hereafter such apparatus will simply be referred to as "leisure apparatus". The leisure apparatus may have in-built capability for the so-called Bluetooth® open wireless technology standard, however, it should be appreciated that the leisure apparatus is not limited to this type of wireless technology/protocol.

2. Background and Related Art

Ice and cooler boxes are adapted to contain ice and/or other cooling media and are employed in a variety of environments and applications to keep food and beverages, etc. cool or cold.

Ice and cooler boxes that have in-built sound systems are known. Such boxes may have speakers, and sockets for connecting (e.g. "plugging-in") portable electronic devices to the boxes, such as those devices employing the so-called MP3 digital audio encoding format ("MP3 players"). The output from the plugged-in portable electronic devices can, via internally housed electronics, be amplified and broadcast from the speakers (e.g. to provide "on-site" music). Examples of such cooler boxes are shown in e.g. U.S. Pat. No. 7,188,491 and US 2008/0031483. However, the sockets of such boxes can become inactive, fouled or damaged by weather, water, dust, dirt, sand, debris and by impact in the environments and applications in which the ice and cooler boxes are employed. Such sockets can also break up (i.e. introduce discontinuity to) the surface in which they are located.

Refrigerators are also known that receive signals from a remote antenna. Examples are shown in Chinese Patent Publication No. 101072357 and Korean Patent Publication No. 2008-0034064. CN 101072357 relates to an internet-enabled type refrigerator, and KR 2008-0034064 relates to a refrigerator having an in-built television or computer, with each refrigerator being able to receive a signal from a remote antenna.

US 2009/0071516 discloses an audio system for an outdoor umbrella in which an audio housing is externally mounted to an umbrella pole. US 2009/0268923 discloses a wireless transmission-AV system for an outdoor furniture in which a speaker unit is mounted onto a frame of the furniture, and a wireless control is electrically connected to the speaker unit for wirelessly linking an AV player with the speaker unit.

US 2009/0021654 discloses a self-contained entertainment system which, in essence, is a portable box. The document discloses that wireless technology may be implemented for one or more of the connections, but does not describe how this may be affected. Rather, in the system of US 2009/0021654, all the componentry is exposed for ease of access and use.

The above references to the background art do not constitute an admission that the art forms a part of the common general knowledge of a person of ordinary skill in the art. The above references are also not intended to limit the application of the leisure apparatus as disclosed herein.

SUMMARY OF THE INVENTION

Disclosed herein is leisure apparatus. The leisure apparatus may take various forms and it should be understood that the terminology therefore embraces a range of apparatus including recreational, outdoor and home-use apparatus. The leisure apparatus as disclosed herein has a volumetric configuration (i.e. height, width and depth). The leisure apparatus can be portable.

For example, the leisure apparatus may take the form of a so-called ice box, cooler box, cooler, ice chest, refrigerator, bar fridge, etc. (hereafter "cooler"). The leisure apparatus may also take the form of luggage such as a backpack, sports or other carry bag, a storage unit such as a cupboard located under a barbecue, a hamper such as a picnic hamper, a carry-all container, seating furniture such as chairs or lounges having a three-dimensional, volumetric profile, or furniture that is inflatable, etc. A number of such apparatus may be portable, able to be carried around and/or may be fabricated for outdoor use. A number of such apparatus may be employed in a wide variety of different environments, applications and leisure activities.

The leisure apparatus as disclosed herein comprises a body. The body has a volume that is able to contain articles for storage therein and for removal therefrom (e.g. in an internal space defined by or within the body). This can, for example, enable the body to function as a cooler, bag, luggage item, carrying item, storage unit, etc.

Alternatively, the body can be adapted such that the internal space is able to seal therein a gas (such as air), a liquid (such as water), or a solid (such as padding, stuffing, an internal support mechanism such as springs, etc.). This ability of the body to seal a gas, liquid or solid therein can enable it, for example, to function as a comfortable furniture item.

In either case, an output device can be arranged externally at the body. In one embodiment the output device may comprise a speaker. Alternatively or additionally, the output device may comprise a video display unit.

The leisure apparatus can also comprise a receiver that is able to receive an electronic signal transmitted wirelessly from a proximate device. The receiver is also able to communicate that signal to the output device.

The receiver can be located behind a wall of the body to be separated from the articles stored in and removed from the body (e.g. to prevent contamination and damage of the receiver by dust, particles, moisture, knocking and bumping, etc.).

For example, the receiver may be sealed behind an external wall, shell or skin of the body (i.e. to protect and insulate the receiver from the environment, and prevent external exposure to water, dust, etc.). Further, the receiver may be sealed within a wall of the body (i.e. to be protected and insulated from both the external and internal environment, and to prevent external and internal exposure to water, dust, etc.).

Alternatively, the receiver can be sealed within a respective compartment of the body (e.g. in an infrequently used or purpose-built compartment of the body). Again this compartment can protect and insulate the receiver from both the external and internal environment, and can minimise or eliminate external and internal exposure to water, dust, etc.).

When the body defines an internal space that is able to seal therein a gas, liquid or solid, the receiver can be located and sealed within the internal space of the body (i.e. to again protect and insulate the receiver from the environment, and to prevent external exposure to water, dust, etc.).

The various forms of leisure apparatus can therefore be provided with a "contained" communication function, and issues such as socket fouling or damage can be avoided. Further, because the body has a volume, the electronics, connectors, etc. of the components, such as the output device and receiver, can be "sealingly housed" within the leisure apparatus, and therefore the possibility for fouling and damage of all components can further be reduced or eliminated.

In one embodiment, when the body contains articles, the apparatus may also perform a carrying function, such as carrying food and beverages; or may function as luggage, including taking the form of various types of bags, hampers, and carry-all containers, etc.

In another embodiment, when the body seals therein a gas, liquid or solid, the body may be filled or inflated with the gas, liquid or solid. The apparatus in this case may function as a furniture item (seat, chair, lounge, etc.).

In one embodiment the receiver may be located together with suitable electronics for communicating (including modulating, amplifying, modifying, etc.) the signal to the output device. Again this ability to co-locate the receiver with suitable electronics arises from the body having a volumetric configuration (height, width and depth).

In one embodiment the proximate device may be a portable electronic device. The reference to a "proximate device" means that the receiver becomes active once e.g. the portable electronic device is in proximity (e.g. within a predetermined distance, such as a few centimeters or meters) of the receiver. The body may comprise external markings which indicate an optimal location for the proximate device (e.g. so as to be in the vicinity of the receiver).

In this embodiment, the receiver may therefore be adapted for receiving the electronic signal from the portable electronic device. The portable electronic device may take the form of an MP3 player, a video player, a hand-held electronic device such as a mobile or smart phone, tablet, laptop, PDA, etc. In this regard, the portable electronic device may employ a digital encoding format. The electronic signal may be transmitted wirelessly in this format to the receiver, and the receiver may be configured to receive that particular format of electronic signal (e.g. in an encoded and/or compressed and/or packeted signal format).

The signal may be transmitted wirelessly according to a standard or protocol. For example, the standard or protocol may be an open wireless technology standard for transmitting data over short distances by short wavelength radio transmissions (e.g. such as the Bluetooth® open wireless technology standard). The signal may be according to an audio format and standard (such as the MP3 audio standard) and/or according to a video format and standard (e.g. the MPEG video compression standard).

In one embodiment both the output device and receiver may be located and sealed within the body.

The volumetric profile of the body may take different forms according to the leisure apparatus. In addition, the location of the output device and receiver may vary in accordance with the different forms of the body.

For example, when the leisure apparatus takes the form of a cooler, the body may comprise top, front, base, side and end panels of the cooler, and optionally a lid or door therefore. The output device and receiver may be located in a respective (or in the same) panel or lid/door of the cooler (e.g. behind or sealed within a wall or lid thereof).

When the leisure apparatus takes the form of luggage, such as a backpack or sports bag, the output device and receiver may be located in a respective (or in the same) panel, flap, wall of the luggage (e.g. behind a wall), may be sealed within a compartment of the luggage (e.g. in a pocket, pouch, etc.).

When the leisure apparatus takes the form of a hamper such as a picnic hamper, or takes the form of a carry-all container, the output device and receiver may be located in a respective (or in the same) panel or lid of the hamper or container (e.g. behind or sealed within a wall or lid thereof).

When the leisure apparatus takes the form of an outdoor or portable cooking apparatus, such as a barbecue, the body may comprise a base unit of the cooking apparatus (e.g. that is insulated from a reminder of the barbecue). The output device and receiver may be located in a respective (or in the same) door or panel of the base unit (e.g. located at, behind or sealed therewithin).

When the leisure apparatus comprises a furniture item, the output device and receiver may be located in auxiliary features of the furniture item that have a volumetric profile, such as an arm, armrest, headrest, back or base of a chair or couch, etc.

When the output device and/or receiver are incorporated into a flap, door or lid for the body, that flap, door or lid may be coupled to the body, or be freely detachable therefrom. If detachable, the output device and receiver may then communicate wirelessly.

In one embodiment, the wall behind which the receiver is located may comprise a detachable panel such as a sealing panel.

When the output device comprises a video display unit, the unit may comprise a graphical user interface or a touch screen. Each of the graphical user interface or touch screen may be used to input information (e.g. for feedback and retransmission to the electronic components, including the proximate device, such as control or selection-type information).

It is to be understood that the terminology "speaker" as employed herein broadly refers to an electro-acoustic transducer that produces sound in response to an electrical audio signal input. The speaker may comprise one or more of a sub-woofer, woofer, mid-range speaker, tweeter and/or super-tweeter.

The receiver, output device, and associated electronics may be powered by a power source, such as a rechargeable battery pack. The battery pack may be incorporated into an internal space of the body. The receiver, output device, and associated electronics may be powered by a solar panel. The rechargeable battery pack may be connected (e.g. via a plug) to an electrical mains power supply, or may be directly connected to the solar panel.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWING

In order that the manner in which the above recited and other features and advantages of the present invention are obtained, a more particular description of the invention will be rendered by reference to specific embodiments thereof, at least one of which is illustrated in the appended drawing. Understanding that the drawing depicts only typical embodiments of the present invention and is not, therefore, to be considered as limiting the scope of the invention, the present invention will be described and explained with additional specificity and detail through the use of the accompanying drawing in which.

DETAILED DESCRIPTION OF THE INVENTION

Various leisure apparatus having a volumetric configuration (i.e. height, width and depth) will now be described with reference to each of FIGS. 1 to 9. In each case it will be seen that the leisure apparatus comprises a body with a three-dimensional, volumetric profile. This enables the various componentry including receiver, transponder, speakers, screens, etc. to be flush or protectively mounted within the apparatus.

Figure 1:
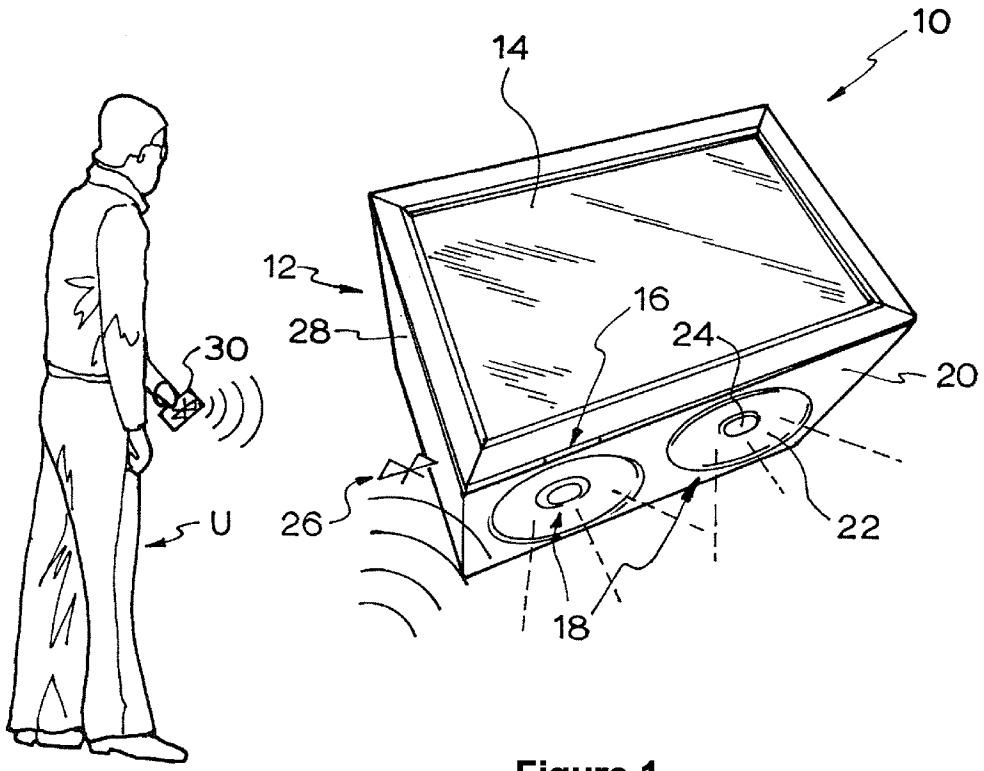
FIG. 1 shows a schematic depiction of a first leisure apparatus embodiment in wireless communication with a portable electronic device.

Referring now to FIG. 1, a first leisure apparatus embodiment, in the form of an icebox 10, is shown. The icebox 10 has a body in the form of a hollow, rectangular prism-like housing 12 and a lid 14 hingedly connected to the housing 12 to pivot between icebox open and closed positions. A latching handle 16 may be mounted to the lid 14, to releasably latch the lid in the icebox closed position. The lid 14 may alternatively be freely detached from the housing 12.

In FIG. 1, an output device in the form of two speakers 18 is shown. The speakers 18 are mounted within a side wall 20 of the housing 12. Whilst each speaker may comprise one of a sub-woofer, woofer, mid-range speaker, tweeter and/or super-tweeter, in FIG. 1 each speaker comprises a woofer 22 and a tweeter 24. For additional protection, but to still enable sound release, the speakers 18 may be located behind a perforated/slotted screen or behind a housing outer skin (e.g. with slots or perforations in the skin for sound release).

A receiver in the form of a receiver/transmitter 26 is located under and wholly mounted within an end wall 28 of the housing 12 (i.e. remote from the side wall 20, although both the receiver transmitter 26 and speakers 18 can be located in the same wall). This mounting within the wall 28 seals, protects and insulates the receiver/transmitter 26 from the environment and from the contents of the icebox 10. When the wall is formed from a tough plastics material, this can even more effectively seal and protect the receiver and its associated electronics.

The receiver/transmitter 26 is able to receive an electronic signal transmitted wirelessly (e.g. streamed in real-time or near real-time, as illustrated in FIGS. 1-9) from an electronic device in a proximate location to it, and to then communicate that signal to the speakers 18 to produce sound. The signal may be amplified, modulated, transformed, modified, etc. by a microprocessor, amplifier, etc. housed within the end wall 28 before being fed to the speaker.

The receiver/transmitter 26 is configured for the Bluetooth® open wireless technology standard, because of the global commercial penetration and acceptance of this standard (the Bluetooth® standard is an open wireless technology standard for transmitting data over short distances by short wavelength radio transmissions).

However, other receivers (and optional transmitters) are able to be employed that can receive an electronic signal transmitted wirelessly and then communicate that signal to the speakers to produce sound. The use of a receiver/transmitter 26 may also enable information to be transmitted back to a remote electronic device (e.g. to optimise performance of the sound system—i.e. the receiver/transmitter 26 may take the form of a transponder).

The receiver/transmitter 26 is configured for wirelessly receiving an electronic signal from a proximate device in the form of a hand-held MP3 player 30, held by a user U. The MP3 player can be placed on or adjacent to the icebox 10, or may be located in a caddy, bracket, etc. (i.e. not a socket) that is mounted to the outside of the end wall 28.

The receiver/transmitter 26 is also configured to receive an electronic signal from other hand-held electronic devices including a mobile or smart phone, tablet, pad, laptop, PDA, etc. Thus, the receiver/transmitter 26 can be provided with broad spectrum functionality. In each case, including in the case of the MP3 player 30, the electronic device employs a digital audio encoding format (such as the MP3 standard/protocol). The electronic signal may be transmitted wirelessly in this format to the receiver/transmitter 26, with the receiver/transmitter 26 being configured to receive that particular format of electronic signal. The signal transmitted can be encoded and/or compressed and/or be in a packeted format.

By mounting the speakers 18, and by sealing the receiver/transmitter 26, microprocessor, amplifier and other electronics within the side wall 20 and end wall 28 of the housing 12, the icebox 10 assumes a "contained" communication function. There are no "plug-in" issues such as socket fouling, short-circuiting, physical damage, etc. from weather, fluids and particulates, or impact from objects and users, either externally or internally of the icebox 10. Also, the profile of the housing 12 is uninterrupted (save for where the speakers are located, although these may also be contained behind a perforated or slotted external skin of the icebox). The speakers can also easily be provided with a protective external screen/grille.

The receiver, speakers, and associated electronics are powered by a rechargeable battery pack incorporated into the housing 12. The battery pack can be recharged by a remote recharger (e.g. a plug-less/socket-less recharger) or by power fed from a solar panel (e.g. that is mounted to or incorporated in a face of the housing or lid). Alternatively, the battery pack may be connected via a plug to an electrical mains power supply, which may directly recharge the battery and/or supply power directly to the electrical and electronic components.

Figure 2:
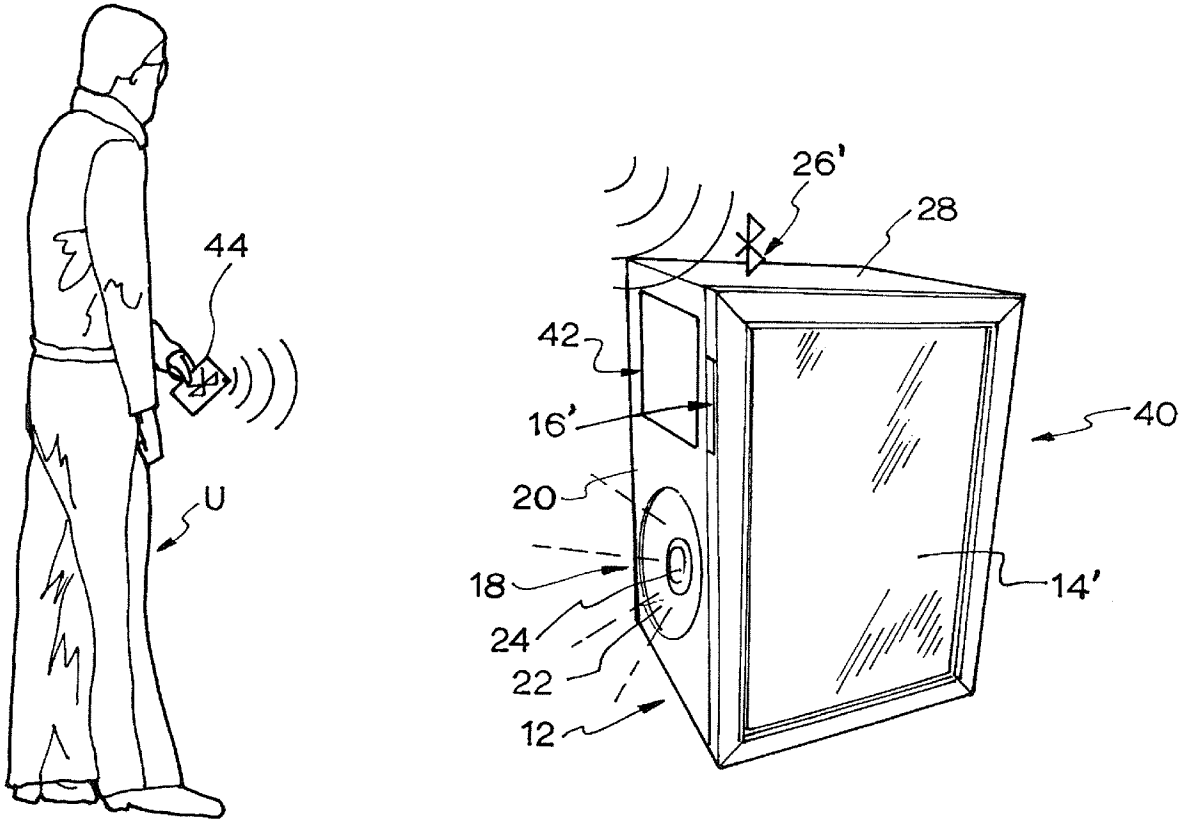
FIG. 2 shows a schematic depiction of a second leisure apparatus embodiment in wireless communication with a portable electronic device.

Referring now to FIG. 2 a second leisure apparatus embodiment is shown in the form of a bar fridge or ice chest 40. In FIG. 2, like reference numerals are otherwise used to denote similar or like parts, and hence will not be re-described.

In the embodiment of FIG. 2, the lid 14 becomes a door 14', and the latch 16, a door handle 16'. In addition, instead of using a bracket or caddy, the player 44 can simply be placed to sit on top of and rest on the top end wall 28 of the bar fridge or ice chest 40 (i.e. adjacent to the receiver/transmitter 26').

Instead of having two speakers 18, the bar fridge or ice chest 40 comprises an output device in the form of one speaker 18 and a touch screen 42. The touch screen 42 can display visual and video-type output converted from a signal transmitted thereto via the player 44.

In this case, the player 44 can transmit wirelessly, using an encoded, compressed signal format for producing an audio output, such as MP3, and the player 44 can wirelessly transmit a signal for producing a video output, such as a compressed video signal according to the MPEG video compression standard.

When the output device includes a touch screen 42, the screen can also be employed by a user to enter information, such as for feeding back to the player 44, and to control e.g. the microprocessor within the housing 12. In this case, the receiver/transmitter 26' can take the form of a transponder. For example, this feedback may include volume control information, music selection information, music sequence information, speaker control information (e.g. base and/or treble control), etc.

The walls of bar fridge or ice chest 40 can be formed from a metal or tough plastics material transmissive to a wireless signal, and can again seal-in and protect the receiver/transmitter 26' and its associated electronics. Again, this mounting within a wall of the bar fridge or ice chest 40 functions to seal, protect and insulate the receiver/transmitter 26' from the environment and from the contents of the bar fridge or ice chest 40.

Figure 3:
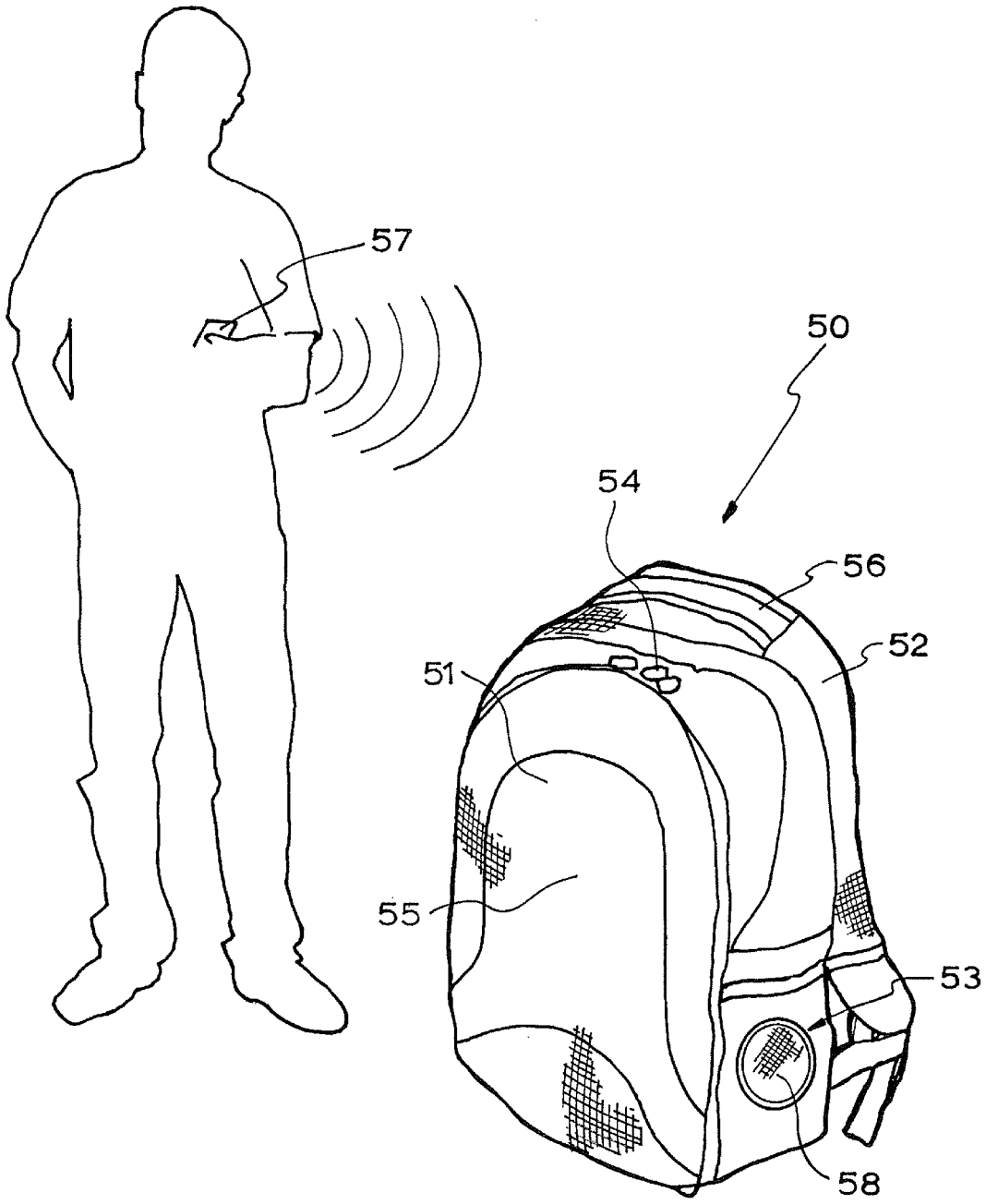
FIG. 3 shows a schematic depiction of a third leisure apparatus embodiment in wireless communication with a portable electronic device.

Referring now to FIG. 3 a third leisure apparatus embodiment is shown in the form of a backpack 50. The backpack 50 has a body in the form of a flexible housing 52 that encloses one or more internal spaces (e.g. pockets or compartments). As is known, the housing 52 can store a range of articles therein (in the pockets or compartments). The backpack 50 also includes a number of fasteners in the form of one or more zippers 54 that each provides access into the different pockets or compartments of the backpack 50. A carry handle 56 is mounted to a top part of the backpack 50.

In the backpack of FIG. 3, an output device in the form of a speaker 58 is shown in a side thereof. More specifically, the speaker 58 is flush mounted within a side panel 53 of the backpack housing 52, with an additional speaker optionally being mounted to an opposing side panel. Each speaker may comprise one of a sub-woofer, woofer, mid-range speaker, tweeter and/or super-tweeter. For additional protection, but to still enable sound release, the speaker 58 may be located behind a perforated/slotted screen, grille or outer skin that extends across and over the side wall 53. Additional speakers may also be mounted on one or more of the panels/walls of the backpack housing 52.

In the backpack of FIG. 3, a receiver in the form of a receiver/transmitter 51 is located behind and wholly mounted within a front wall 55 of the housing 52, at a location remote from the side wall 53 (although both the receiver/transmitter 51 and speaker 58 can be located in the same wall). This mounting can be within a compartment or pocket of the backpack 50 (e.g. a dedicated or reconfigured compartment or pocket) and functions to seal, protect and insulate the receiver/transmitter 51 from the exterior, and also from other compartments/pockets of the backpack. When the wall 55 is formed from a tough and tightly woven (e.g. synthetic) material, this can again protect the receiver and its associated electronics, including from moisture and dust ingress.

The backpack of FIG. 3 can be used with a hand-held (portable) player 57 which can transmit a signal wirelessly to the receiver/transmitter 51. The player 57 may sit on top of or even be clipped to the backpack 50. The signal format can be an encoded, compressed signal format for producing an audio output, such as MP3. The player 57 may also wirelessly transmit a signal for producing a video output, such as a compressed video signal according to the MPEG video compression standard.

The backpack 50 may also be provided with a touch screen to enable a user to enter information, such as for controlling output (e.g. via a microprocessor located within the housing 52), and optionally can be used to feedback information to the player 57. In this latter case, the receiver/transmitter 51 can take the form of a transponder. For example, this feedback may include volume control information, music selection information, music sequence information, speaker control information (e.g. base and/or treble control), etc.

Figure 4:
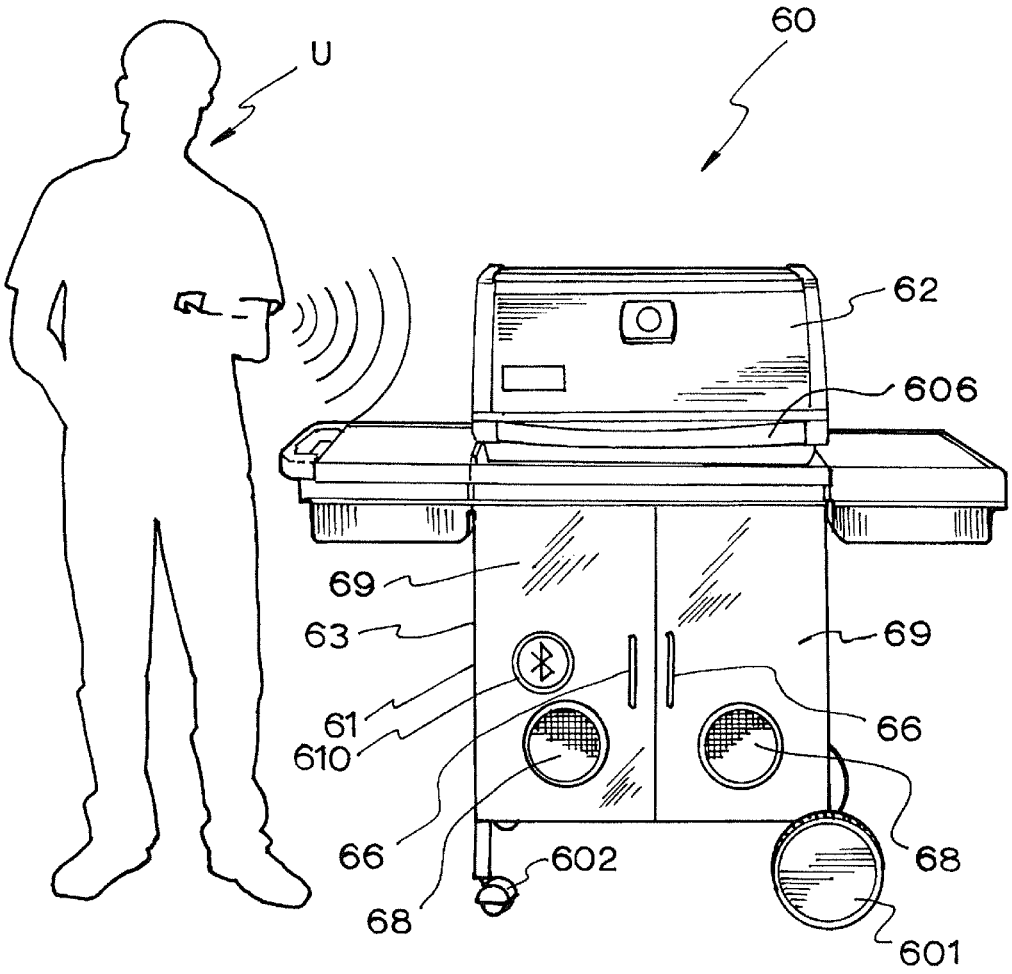
FIG. 4 shows a schematic depiction of a fourth leisure apparatus embodiment in wireless communication with a portable electronic device.

Referring now to FIG. 4 a fourth leisure apparatus embodiment is shown in the form of a barbecue 60. The barbecue 60 has a body in the form of a base unit 61 that encloses an internal space (i.e. functioning as a cupboard). The internal space of the base unit 61 may be used to house a range of articles such as cooking implements and utensils, barbecue cleaners, fat drip trays, etc. The base unit 61 includes front swing doors 69 that enable access into the enclosed internal space of base unit 61. A handle 66 may be mounted on each door 69.

The base unit 61 of barbecue 60 is also provided with wheels 601 and castors 602 that enable the barbecue 60 to be moved about. Further, the barbecue 60 as shown comprises a hood 62 that covers and encloses its hotplates/grill and a hood handle 606.

The barbecue of FIG. 4 specifically comprises an output device in the form of twin speakers 68. The speakers 68 are respectively mounted within the doors 69. Additional speakers may be mounted in one or each side wall 63 of the base unit 61. Each speaker may comprise one of a sub-woofer, woofer, mid-range speaker, tweeter and/or super-tweeter. For additional protection, but to still enable sound release, the speakers 68 may be located behind a perforated/slotted screen/grille.

A receiver in the form of a receiver/transmitter 610 is located behind to be mounted within one of the doors 69 of the base unit 61. Alternatively, the receiver/transmitter 610 can be located behind to be mounted within one of the side walls 63 of the base unit 61. In each case, the receiver/transmitter 610 is remotely located from an in-use hot grill part of the barbecue 60.

The door 69 and/or wall 63 may be formed from a metal or plastic material transmissive to a wireless signal, and can seal and protect the receiver/transmitter 610 and its associated electronics. The mounting within the door 69 and/or wall 63 also protects and insulates the receiver/transmitter 61 from heat and oil splashes during the operation of the barbecue 60. The receiver/transmitter 610 and one of the speakers 68 can thus be located in the same door 69.

Figure 5:
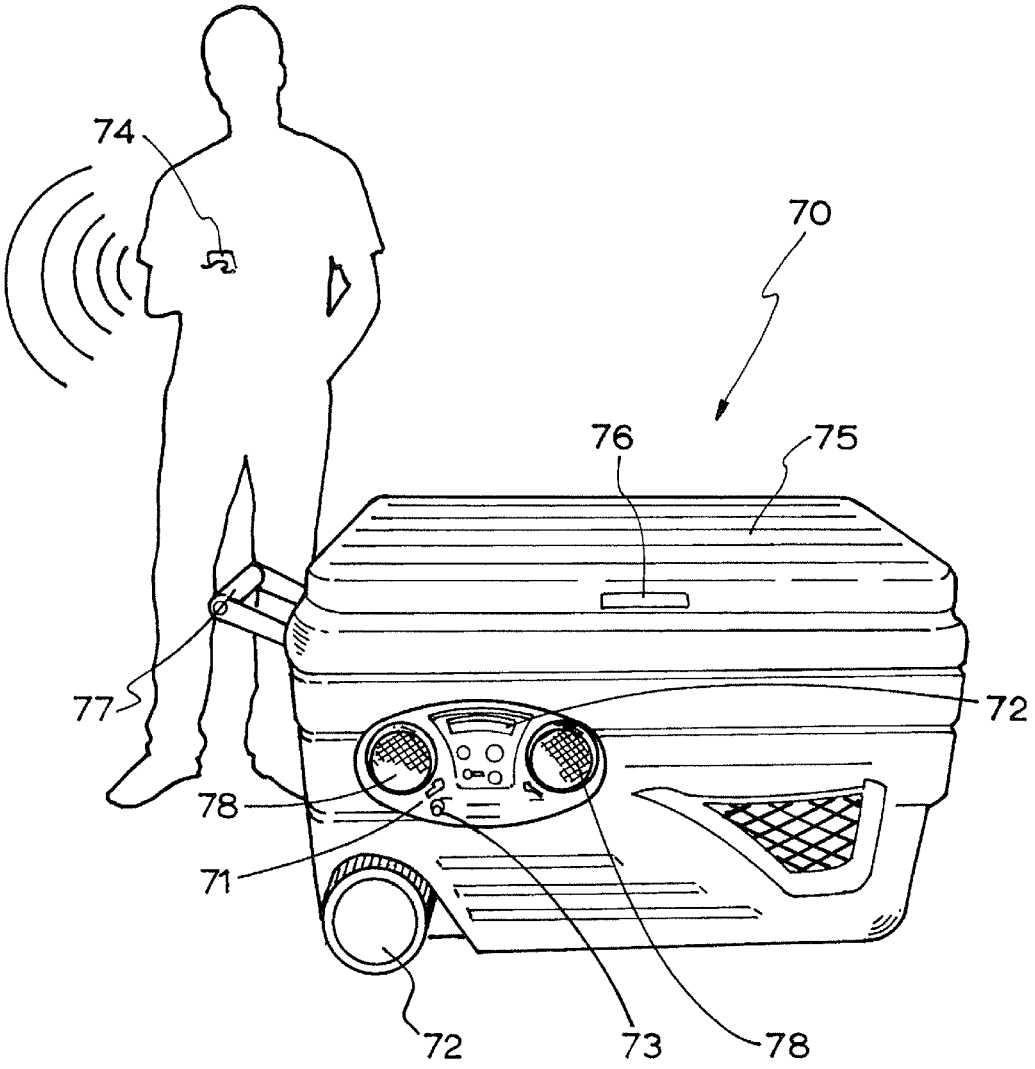
FIG. 5 shows a schematic depiction of a fifth leisure apparatus embodiment in wireless communication with a portable electronic device.

Referring now to FIG. 5, a fifth leisure apparatus is disclosed in the form of a portable (i.e. wheelable) cooler 70. The cooler 70 comprises a hinged lid 74 having a latch 76 and an end-mounted tow-handle 77. In addition, the cooler 70 comprises opposing wheels 72 located at an opposite end thereof.

A control panel 71 is mounted into a side wall of the cooler 70. The control panel 71 comprises an output device in the form of two speakers 78, and control knobs/dials 72. The control knobs 72 may be used to control various sound parameters such as volume, bass, treble, speaker balance, etc. The control panel 71 may be modified to include a visual display and video-type output.

A receiver/transmitter 73 is located under the control panel 71 (or may be located elsewhere in the cooler 70, remotely from the control panel 71). The control panel 71 thus seals the receiver/transmitter 73 from the exterior, with an opposing internal wall of the cooler 70 sealing the receiver/transmitter 73 from the cooler interior. The receiver/transmitter 73 can also take the form of a transponder so that it can communicate with and feedback to a remotely held player 74.

The receiver/transmitter 73 receives a signal transmitted thereto via the player 74. The player 74 can transmit wirelessly, using an encoded, compressed signal format for producing an audio output, such as MP3, and optionally may wirelessly transmit a signal for producing a video output, such as a compressed video signal according to the MPEG video compression standard.

When the control panel 71 includes a touch screen, the screen can also be employed by a user to enter information, such as for feeding back to the player 74, and to control e.g. the microprocessor within the control panel 71.

The side wall of the cooler 70 and the control panel 71 can each be formed from a tough metal or plastics material to seal and protect the receiver and its associated electronics.

Figure 6:
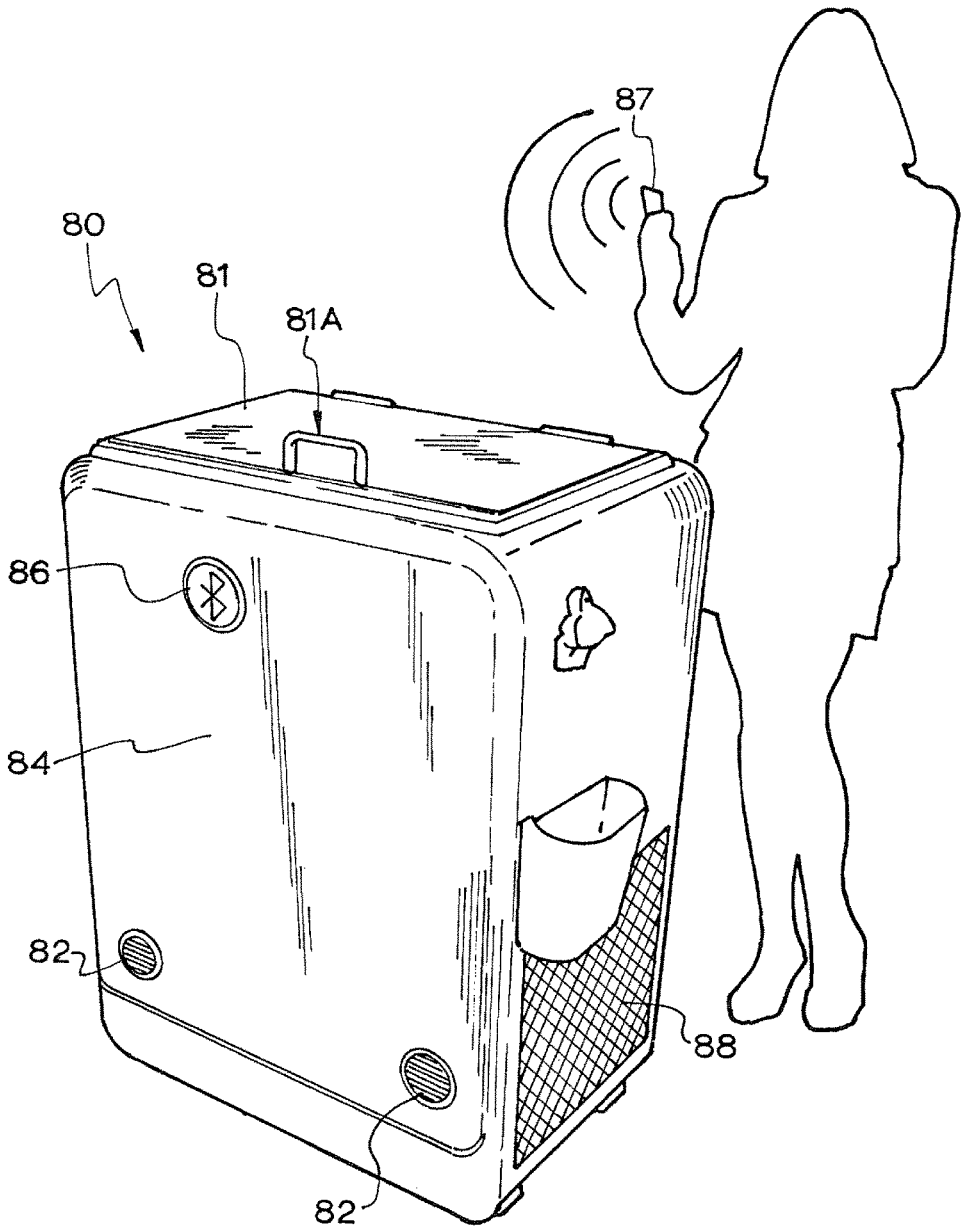
FIG. 6 shows a schematic depiction of a sixth leisure apparatus embodiment in wireless communication with a portable electronic device.

Referring now to FIG. 6, a sixth leisure apparatus is shown in the form of a bar fridge 80. The bar fridge 80 comprises a top-mounted swing-up lid 81 and handle 81A.

The bar fridge 80 also comprises an output device in the form of twin speakers 82. The speakers 82 are mounted within a front wall 84 of the bar fridge. Additional speakers 85 may be mounted in one or each side wall of the fridge. Each speaker may comprise one of a sub-woofer, woofer, mid-range speaker, tweeter and/or super-tweeter. For additional protection, but to still enable sound release, the speakers 82, 85 may be located behind a perforated/slotted screen/grille (e.g. see side grille 88).

Again, a receiver/transmitter 86 can also be located in the front wall 84, or it may be located in the side walls or top panel of the fridge. Again, the receiver/transmitter 86 can also take the form of a transponder so that it can communicate with and feedback to a remotely held player 87. The wall 84 and side walls of the bar fridge can again be formed a metal or plastic transmissive to a wireless signal, to seal thereunder and protect the receiver/transmitter 86 and its associated electronics. The remaining functions of the receiver/transmitter 86 and player 87 are as described above.

Figure 7:
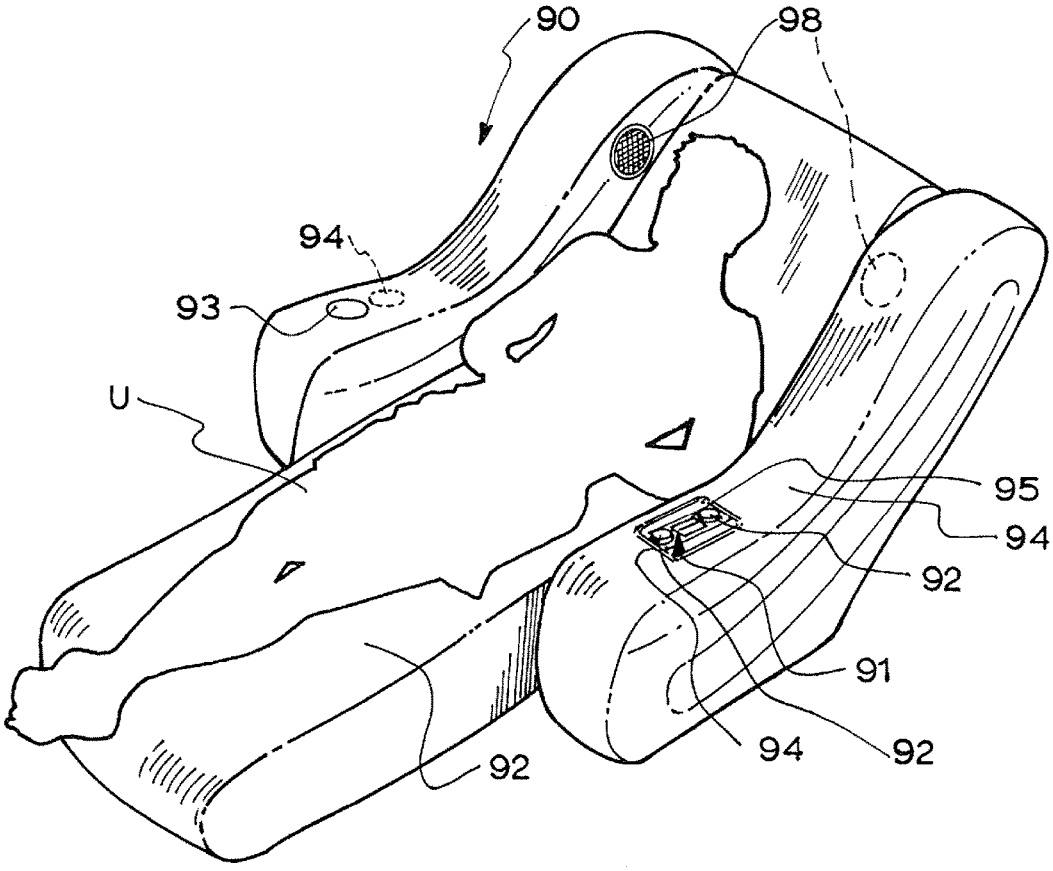
FIG. 7 shows a schematic depiction of a seventh leisure apparatus embodiment in wireless communication with a portable electronic device.

Referring now to FIG. 7, a seventh leisure apparatus embodiment is shown in the form of inflatable or fluid-fillable/filled furniture. In this embodiment the furniture takes the form of a recliner 90. A body 92 of the recliner 90 encloses an internal space that is inflatable with a gas (such as air) or which may hold a fluid (such as a liquid; e.g. water), or a fluidisable material such as solid polymeric foam particles (e.g. polystyrene foam balls). The body 92 provides underlying support to a user U as shown.

The recliner 90 has auxiliary support structures in the form of armrests 94 mounted (e.g. integrally formed) on either side of the body 92. The armrests 94 provide the user with additional support and can also be used to support other items (such as cups, plates, utensils, glasses, a hat, towel, etc.—see e.g. cup holder 93).

In the recliner 90 of FIG. 7, an output device in the form of speakers 98 are mounted within respective armrests 94 at the upper end of the inside face of each armrest (i.e. to be adjacent to the ears of a reclining user). Each speaker 98 may be located behind a perforated/slotted and usually waterproof screen/grille. Additional speakers may be mounted in the recliner (e.g. at outward facing surfaces of the armrests).

A control panel 91 is mounted into an upper surface of one of the armrests 94. The control panel comprises control knobs/dials 92. The control knobs 92 may be used to control various sound parameters such as volume, bass, treble, speaker balance, etc. The control panel may again be modified to include a visual display and video-type output.

A receiver/transmitter 94 can also be located under the control panel 91, sealed thereby within the armrest 94 (or may be located remotely therefrom, elsewhere within the recliner—e.g. within the opposite armrest 94). The receiver/transmitter 94 can also take the form of a transponder so that it can communicate with and feedback to a remotely located player 95. The player 95 can also be securely located in e.g. a cradle defined in the control panel 91. The control panel 91 can again seal thereunder and protect the receiver/transmitter 94 and its associated electronics. The remaining functions of the receiver/transmitter 94 and player 95 are as described above.

Figure 8:
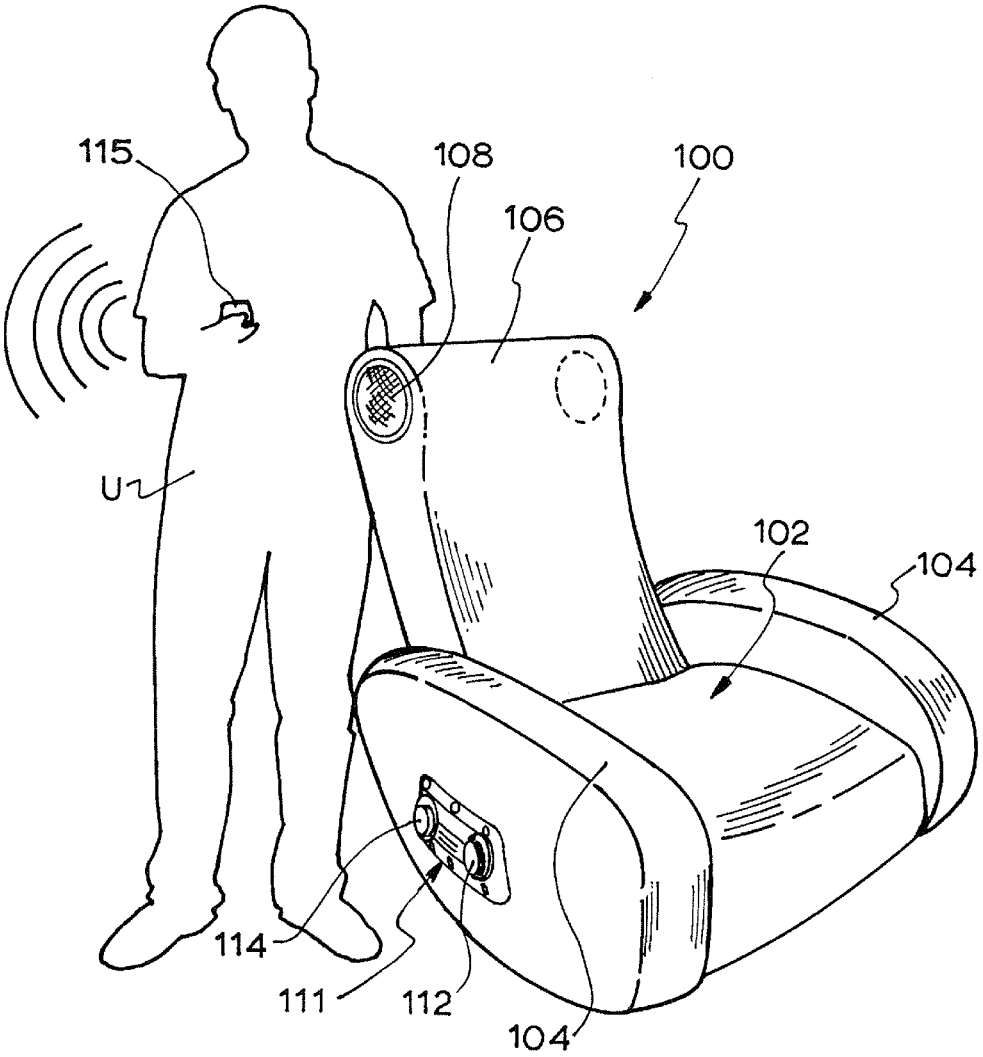
FIG. 8 shows a schematic depiction of a eighth leisure apparatus embodiment in wireless communication with a portable electronic device.

FIG. 8 discloses an eighth leisure apparatus in the form of inflatable or fluid-fillable furniture. In this embodiment the furniture takes the form of a chair 100. Again, a body 102 of the chair 100 encloses an internal space that is inflatable with a gas (such as air) or a fluid (e.g. a liquid such as water), or a fluidisable material (e.g. a solid polymeric foam particle such as polystyrene foam balls). The body 102 provides underlying support to a user U. The chair 100 has auxiliary support structures in the form of armrests 104 mounted on the body 102. The armrests 104 provide the user with additional support and can also be used to support other items (such as cups, plates, utensils, glasses, a hat, towel, etc.).

In the chair of FIG. 8, an output device in the form of speakers 108 are mounted within respective sides of a backrest 106 of the chair (i.e. at the upper end of the outside face of the backrest, to locate adjacent to the ears of a seated user). Each speaker 108 may be located behind a perforated/slotted and usually waterproof screen/grille. Additional speakers may be mounted to the chair (e.g. at outward facing surfaces of the armrests).

A control panel 111 is mounted into an outside surface of one of the armrests 104. The control panel comprises control knobs/dials 112 which may be used to control various sound parameters such as volume, bass, treble, speaker balance, etc. The control panel may again be modified to include a visual display and video-type output.

A receiver/transmitter 114 can be located under the control panel 111, sealed thereby within the armrest 104. Alternatively, the receiver/transmitter 114 may be located remotely from the control panel, elsewhere within the recliner (e.g. within the opposite armrest 104).

The receiver/transmitter 114 can again take the form of a transponder so that it can communicate with and feedback to a remotely held player 115. The control panel 111 can again seal thereunder and protect the receiver/transmitter 114 and its associated electronics. The remaining functions of the receiver/transmitter 114 and player 115 are as described above.

Figure 9:
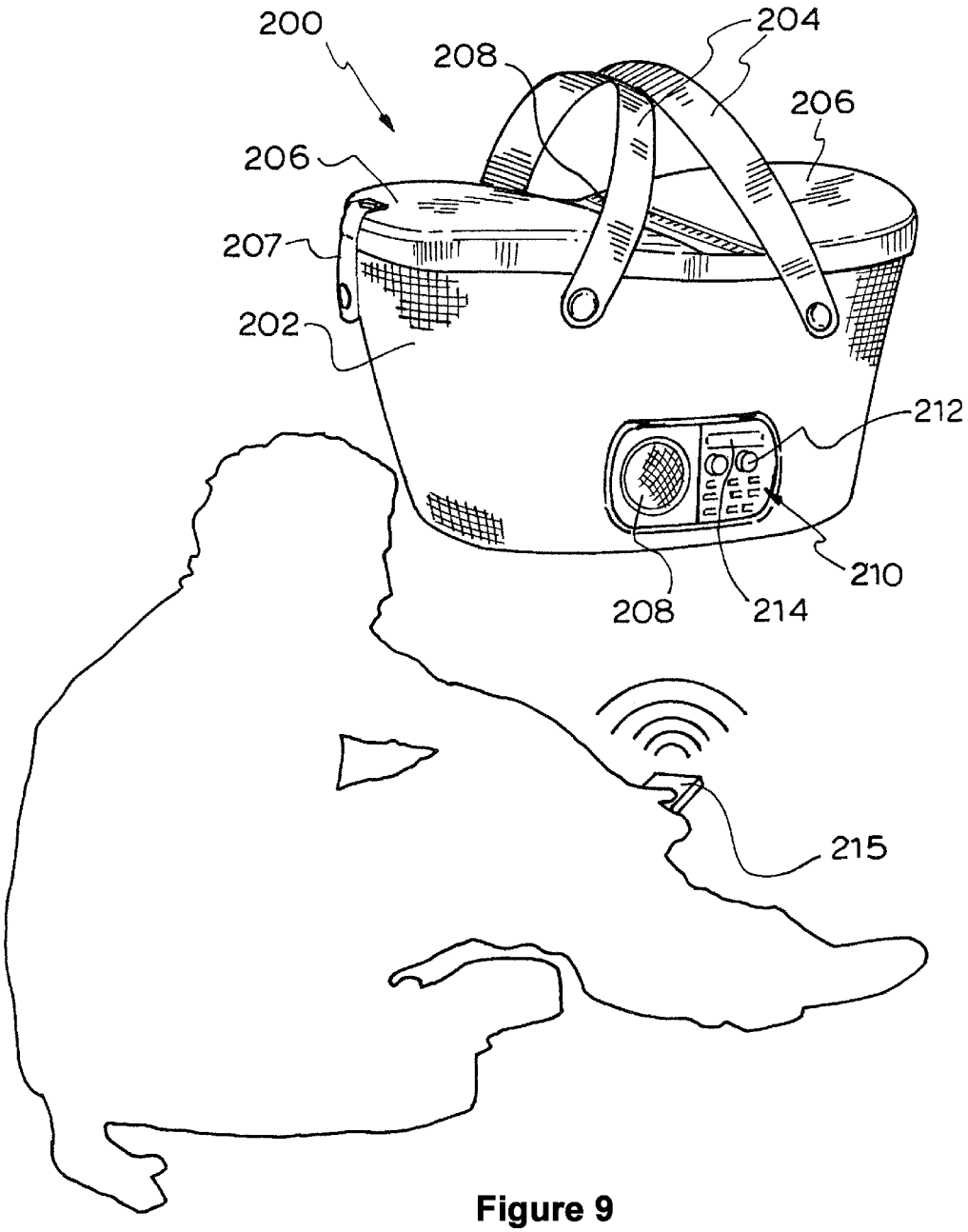
FIG. 9 shows a schematic depiction of a ninth leisure apparatus embodiment in wireless communication with a portable electronic device.

FIG. 9 discloses a ninth leisure apparatus in the form of a hamper 200. Again, a body 202 of the hamper 200 encloses an internal space that can hold items such as food, drink, cutlery, crockery, cups, rugs, cloths, napkins, etc. The body 202 includes handles 204 mounted on the body to extend upwardly therefrom and to enable the hamper to be carried. The body 202 also includes lid flaps 206 to enclose items in the body interior. Each lid flap 206 is secured along an inside edge to a central support strap 207, to pivot upwardly therefrom. Each lid flap 206 is also securable at its periphery, via a zip 208, to a rim of the body.

In the hamper of FIG. 9, an output device in the form of a speaker 208 is mounted within a control panel 210. The speaker 208 may be located behind a perforated/slotted and usually waterproof screen. Additional speakers may be mounted to the hamper (e.g. at ends or at an opposing side of the body 202).

Again, the control panel 210 is mounted into an outside surface of the body 202. The control panel comprises control knobs/dials 212 which may be used to control various sound parameters such as volume, bass, treble, speaker balance, etc. The control panel may again be modified to include a visual display and video-type output.

A receiver/transmitter 214 is located under the control panel 210, sealed thereby within a compartment extending into the hamper interior. Alternatively, the receiver/transmitter 214 may be located remotely from the control panel, elsewhere within the hamper walls or lids (e.g. within a dedicated compartment or capsule mounted within the hamper wall or lid). The receiver/transmitter 214 can again take the form of a transponder so that it can communicate with and feedback to a remotely held player 215. The control panel 210 can again seal thereunder and protect the receiver/transmitter 214 and its associated electronics. The remaining functions of the receiver/transmitter 214 and player 215 are as described above.

In any of the embodiments described herein the receiver/transmitter/transponder, electronics, speakers and/or video screen can be integrated into (to be sealingly protected thereby) one or more panels that may be secured within a volumetric profile of the leisure apparatus.

When the housing takes e.g. a round, cylindrical or spherical form, it may comprise just a single wall and optionally a lid, and within which the receiver/transmitter/transponder, speakers, power source and electronics may be incorporated. When the housing takes e.g. a flexible form, it may comprise rigid panels and frames, attached to the remainder of the flexible housing, and to which the receiver/transmitter/transponder, speakers, power source and electronics may be mounted.

The leisure apparatus may also take the form of a carry-all container, configured much like the ice box and cooler shown in each of FIGS. 1 and 5. In this case, the receiver/transmitter/transponder, electronics, speakers and/or video screen can be integrated into a lid, or side or end wall(s) of the container.

It will be understood to persons skilled in the art that many other modifications may be made without departing from the spirit and scope of the leisure apparatus as disclosed herein.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the leisure apparatus.

What is claimed is:

1. A leisure apparatus comprising:

at least one of a cooler and a cooling apparatus comprising:

a body comprising a rigid material and having a volume that is able to contain articles for storage therein and for removal therefrom;

an output device arranged externally at the body; and a receiver arranged to be at least one of located (i) behind a wall of the body, (ii) within the wall of the body, and (iii) within a compartment of the body, to be separated from articles stored in and removable from the body, the receiver being configured to:

receive an electronic signal transmitted wirelessly from a proximate portable electronic media device in a packeted signal format and according to a wireless technology standard or protocol for transmitting data over short distances by short wavelength radio transmissions; and stream that electronic signal to the output device in real time.

2. The apparatus of claim 1, wherein the receiver is sealed behind an external wall, shell or skin of the body.

3. The apparatus of claim 2, wherein the receiver is sealed within the wall of the body.

4. The apparatus of claim 1, wherein the portable electronic device employs a digital encoding format, in which format the electronic signal is transmitted wirelessly to the receiver, with the receiver being configured to receive that format of electronic signal.

5. The apparatus of claim 1, wherein the output device comprises a speaker.

6. The apparatus of claim 1, wherein the body forms part of the cooler, and wherein the receiver is sealed within the wall of the cooler or within a lid of the cooler so as to be separated from articles stored in and removable from the cooler.

7. The apparatus of claim 1, wherein the body forms part of a bag, wherein the receiver is sealed within the compartment of the bag, the compartment being separate to a discrete compartment in which the articles are stored and from which the articles are removable.

8. The apparatus as claimed in claim 1, wherein the output device comprises a display unit.

9. A leisure apparatus comprising:

a body having a volume that defines an internal space that is able to seal therein a gas, liquid or solid;

an output device arranged externally at the body; and a receiver disposed at least one of (i) behind a wall of the body, (ii) in the wall of the body, and (ii) within the internal space, and arranged to be separated from articles stored in and removable from the body, the receiver being configured to:

receive an electronic signal transmitted wirelessly from a proximate portable electronic media device in a packeted signal format and according to a wireless technology standard or protocol for transmitting data over short distances by short wavelength radio transmissions; and stream that electronic signal to the output device in real-time.

10. The apparatus of claim 9, wherein the receiver is located behind an external wall, shell, or skin of the body.

11. The apparatus of claim 9, wherein the portable electronic device employs a digital encoding format, in which format the electronic signal is transmitted wirelessly to the receiver, with the receiver being configured to receive that format of electronic signal.

12. The apparatus of claim 9, wherein the output device comprises a speaker.

13. The apparatus of claim 9, wherein the body forms part of a furniture item, with the internal space that seals therein the gas, liquid or solid being defined within the furniture item.

14. The apparatus of claim 13, wherein at least one of the output device and the receiver are located within at least one of an armrest, a back and a headrest of the furniture item.

15. The apparatus as claimed in claim 9, wherein the output device comprises a display unit.

16. A leisure apparatus comprising:

a body having a volume that is configured to contain articles for storage therein and for removal therefrom;

an output device arranged to provide at least one of audio output and visual output external to the body; and a receiver configured to be separated from articles stored in and removable from the body, the receiver being adapted to receive an electronic signal transmitted wirelessly from a proximate portable electronic media device and to stream that electronic signal to the output device in real-time, wherein the electronic signal is configured to be transmitted wirelessly from the portable electronic media device in a packeted signal format and according to a wireless technology protocol for transmitting data over short distances by short wavelength radio transmissions.

17. The apparatus of claim 16, wherein the leisure apparatus comprises a cooler and wherein the output device comprises a speaker.

18. The apparatus of claim 16, wherein the leisure apparatus comprises a cooler and wherein the output device comprises a display unit.

19. The apparatus of claim 16, wherein the body forms part of a cooler, and wherein the receiver is disposed at least one of in a wall of the cooler, behind the wall of the cooler, within a lid of the cooler, and within a compartment of the cooler so as to be separated from items stored in and removable from the cooler.

20. The apparatus of claim 16, wherein:

the apparatus comprises at least one of a cooler and a cooling apparatus, the body comprises a rigid material, the receiver is at least one of (i) disposed at a wall of body and (ii) sealed within a compartment of the body, and the output device comprises a speaker.

* * * * *